US007046949B2

(12) United States Patent
Tomita et al.

(10) Patent No.: US 7,046,949 B2
(45) Date of Patent: May 16, 2006

(54) IMAGE FIXING APPARATUS USING PULSATING POWER FOR HEATING

(75) Inventors: Kunihiko Tomita, Kanagawa (JP); Naoki Iwata, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 22 days.

(21) Appl. No.: 10/247,631

(22) Filed: Sep. 20, 2002

(65) Prior Publication Data

US 2003/0059224 A1 Mar. 27, 2003

(30) Foreign Application Priority Data

Sep. 21, 2001 (JP) ..... 2001-290062

(51) Int. Cl.
*G03G 15/20* (2006.01)

(52) U.S. Cl. ..... 399/329; 219/216

(58) Field of Classification Search ..... 399/69, 399/328, 329, 68, 70, 330; 219/216
See application file for complete search history.

(56) References Cited

U.S. PATENT DOCUMENTS 5,114,337 A * 5/1992 Yamazaki ..... 432/8
5,220,383 A 6/1993 Enoki et al.
5,225,874 A * 7/1993 Koh et al. ..... 399/69
5,245,391 A 9/1993 Suzuki et al.
5,311,263 A 5/1994 Suzuki et al.
5,339,141 A 8/1994 Suzuki et al.
5,365,314 A * 11/1994 Okuda et al. ..... 399/69
5,367,369 A * 11/1994 Nakai et al. ..... 399/69
5,424,814 A 6/1995 Suzuki et al.
5,444,521 A * 8/1995 Tomoyuki et al. ..... 399/69
5,450,172 A 9/1995 Suzuki et al.
5,502,552 A 3/1996 Iwata et al.
5,527,657 A 6/1996 Takeda et al.
5,541,029 A 7/1996 Iwata et al.
5,557,392 A 9/1996 Iwata
5,801,360 A * 9/1998 Oba et al. ..... 219/216
5,809,386 A 9/1998 Iwata
5,812,917 A 9/1998 Iwata et al.
5,869,213 A 2/1999 Iwata et al.

(Continued)

FOREIGN PATENT DOCUMENTS

EP 0 370 520 5/1990

(Continued)

OTHER PUBLICATIONS

U.S. Appl. No. 09/842,156, filed Apr. 26, 2001, allowed.

(Continued)

*Primary Examiner*—Robert Beatty
(74) *Attorney, Agent, or Firm*—Oblon, Spivak, McClelland, Maier & Neustadt, P.C.

(57) ABSTRACT

An image fixing apparatus having a linear heating body with an endless belt entrained around thereon, using an electrical power supply to provide pulsating power to the linear heating body. Additionally, a pressure body interposes the subject to be fixed containing an image on the endless belt, and the image is heated by the linear heating body through the endless belt. The subject is thereafter cooled and removed from the endless belt. The image is formed by using a toner containing a binder which contains a resin as a main component. Either the softening point or the melting point of the toner is between 50° C. to 160° C., and the viscosity of the toner is between 10 to $10^{13}$ centi-poise at a temperature greater than either the softening point or the melting point of the toner.

35 Claims, 11 Drawing Sheets

U.S. PATENT DOCUMENTS

| | | | | |
|---|---|---|---|---|
| 6,087,641 | A * | 7/2000 | Kinouchi et al. | 219/619 |
| 6,370,350 | B1 | 4/2002 | Tomita | |
| 6,370,352 | B1 | 4/2002 | Tomita | |
| 6,413,690 | B1 | 7/2002 | Tomita | |
| 6,492,084 | B1 | 12/2002 | Tomita | |
| 2001/0006583 | A1 | 7/2001 | Tomita | |

FOREIGN PATENT DOCUMENTS

| | | | |
|---|---|---|---|
| JP | 51-29825 | | 8/1976 |
| JP | 01-263685 | | 10/1989 |
| JP | 02-105189 | | 4/1990 |
| JP | 02190870 | A * | 7/1990 |
| JP | 03-034284 | | 2/1991 |
| JP | 05-002349 | | 1/1993 |
| JP | 05-019646 | | 1/1993 |
| JP | 05-0196463 | | 1/1993 |
| JP | 06-175518 | | 6/1994 |
| JP | 06-194979 | | 7/1994 |
| JP | 08-185080 | | 7/1996 |
| JP | 2516886 | | 7/1996 |
| JP | 08-211766 | | 8/1996 |
| JP | 11-002985 | | 1/1999 |
| JP | 11084941 | A * | 3/1999 |
| JP | 2001-147608 | | 5/2001 |

OTHER PUBLICATIONS

U.S. Appl. No. 09/933,153, filed Aug. 21, 2001, pending.
U.S. Appl. No. 10/133,754, filed Apr. 29, 2002, pending.
U.S. Appl. No. 10/424,077, filed Apr. 28, 2003, Suzuki et al.
U.S. Appl. No. 10/200,519, filed Jul. 23, 2002, Tomita et al.
U.S. Appl. No. 10/457,543, filed Jun. 10, 2003, Tomita.
U.S. Appl. No. 10/445,941, filed May 28, 2003, Tomita et al.
U.S. Appl. No. 10/247,631, filed Sep. 20, 2002, Tomita et al.
U.S. Appl. No. 10/645,614, filed Aug. 22, 2003, Sohmiya et al.

* cited by examiner

The status of temperature variance of the fixing roller

A schematic view when the pulse-widths are varied

A schematic view when the values ofpulse density (density of pulse electricity cycle) is varied Temperature Variance of Fixing Roller Integration Waveform when the pulse-widths are varied Temperature Variance of Fixing Roller Integration Waveform when the pulse-widths or the pulse-density is varied

IMAGE FIXING APPARATUS USING PULSATING POWER FOR HEATING

FIELD OF THE INVENTION

The present invention relates to an image fixing apparatus and a process for fixing an image in electrophotography utilized in a copying machine, facsimile, or a printer, and more particularly to an image fixing apparatus and a process for fixing an image which is useful in saving energy.

DESCRIPTION OF THE RELATED ART

Conventionally, there is an increasing demand for saving resources and energy for the sake of preserving global environment. In a technology utilizing electrophotography, a trend in saving electricity for the purpose of saving energy has been actively pursued, specifically in the technology of image fixing which accompanies rapid consumption of electricity, thereby calling for fixing in low temperatures. In order to achieve a low-temperature fixing, a melting point or a softening point of a toner inevitably needs to be decreased, and when melting point or softening point of a thermoplastic resin contained in the toner is decreased, a melt viscosity of such thermoplastic resin tends to deteriorate. In such thermoplastic resins, the melting point or the softening point is determined by an amount of molecules, distribution in molecular amounts, rate of crystallization, rate of cross-linking, and intermolecular forces. In order to decrease the melting point or the softening point of such resins sharing the same structures, the amount of molecules, the rate of cross-linking, or distribution of molecules need to be reduced among the conditions mentioned above. However, in terms of distribution of molecular amount, there is a limit in order to maintain resin preservability, and accordingly, the bottom line is inevitably determined. Consequently, when amount of molecules is decreased, the distribution of molecular amount is narrowed. Generally, when an amount of molecules is decreased, melt viscosity deteriorates due to weakened bonding force interacting between the molecules owing to shortened molecular chains. The melt viscosity also deteriorates when distribution of molecular amount is narrowed due to the weakened bonding force interacting on molecular chains. Further, melt viscosity deteriorates when the rate of cross-linking between the molecules is reduced, due to easy moving of molecules. However, as disclosed in the Japanese Patent Application Publication JP-B) No. 51-29825, there is a process for fixing the toners deteriorated in melt viscosity without causing off-settings.

Another technology which utilizes such method is for example, disclosed in the Japanese Patent No. 2,516,886. According to this publication, the heater element in the JP-B 51-29825 is configured as a linear heater element provided with pulse electricity, and having a structure to suppress excess heat exhaustion within the system. By such arrangements, advantages such as unnecessary preheating which contributes to shortened standing time is attained.

However, when heating using unvaried pulse electricity, a temperature in the front edge portion of an image tends to be low due to insufficient heat of the heating body, a supporting body thereof, or a platen roller which remain cool. On the other hand, in the rear edge portion of an image, temperatures of the heating body, the supporting body of the heating body, or the platen roller tends to increase due to heat accumulation, thereby difference in temperature tends to be caused between the front edge portion and the rear edge portion of the image. As a countermeasure to such phenomenon, there is a method in which the temperature in the front edge portion of the image is set higher to avoid defective fixing while area of a rubber region in the toner is determined larger to cope with the temperature increase in the rear edge portion of the image. However, when the melting point of the toner is set low from the stand point of saving energy, it becomes very difficult to retain enough rubber regions, and hence, hot-offsetting is caused, or if not causes hot-offsetting, glossiness in the image tends to be produced due to excessively deteriorated melt viscosity of the toner. Moreover, if the temperature is set higher from the beginning, an effect of saving energy which the method aims to attain may be spoiled, and therefore, a different technological approach to attain saving in energy is pursued.

SUMMARY OF THE INVENTION

By carefully reflecting on the drawbacks of the conventional art, the present invention provides a process for fixing a toner image and an image fixing apparatus which further saves energy while maintains stability in operation without causing off-settings and the like.

The first aspect of the present invention provides an image fixing apparatus, comprising: a linear heating body; an endless belt entrained around thereon; means for supplying electricity to the linear heating body with pulse electricity; a pressure body for interposing a subject to be fixed having an image between the endless belt; the image is heated by the linear heating body by way of the endless belt, and thereafter being cooled and removed from the endless belt; wherein the image is formed by a toner comprising a binder containing a resin as a main component, and one of a softening point and a melting point of the toner is in the range of 50 to 160° C., and a viscosity of the toner is in the range of 10 to $10^{13}$ centi-poise at temperature of one of a softening point and a melting point or more of the toner.

In the second aspect of the present invention, there is provided a process for fixing an image, comprising: a process for interposing a subject to be fixed having an image between a pressure body and an endless belt entrained around a linear heating body which receives pulse electricity from means for supplying pulse electricity, in an image fixing apparatus; a process for heating the image by the linear heating body by way of the endless belt; a process for separating the subject for fixing image from the endless belt after the image is cooled, wherein the image is formed by a toner comprising a binder containing a resin as a main component, and one of a softening point and a melting point of the toner is in the range of 50 to 160° C., and a viscosity of the toner is in the range of 10 to $10^{13}$ centi-poise at temperature of one of a softening point and a melting point or more of the toner.

DESCRIPTION OF THE PREFERRED EMBODIMENTS

Figure 1:
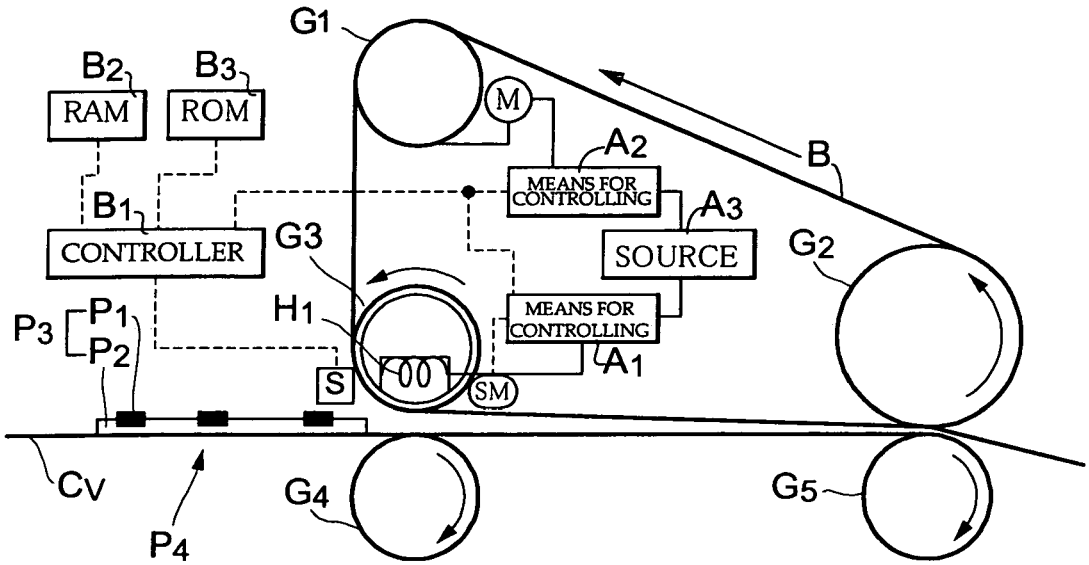
FIG. 1 is a schematic-view showing one example of the image fixing apparatus of the present invention furnished with thermal i.e., heating-and-cooling configuration.

The present invention will be described hereinafter in detail. The present invention provides an image fixing system which is a system for fixing a toner image, comprising: a linear heating body, an endless belt entrained around thereon, a pressure body for interposing a subject to be fixed having an image between the endless belt, and means for supplying pulse electricity to the heating body, wherein an image on the subject to be fixed is heated by the linear heating body by way of the endless belt, and separates the subject to be fixed from the endless belt following a step for cooling, and the image is formed by a toner comprising a bonding agent in which the main ingredient is a resin, the softening point or the melting point of the toner is in the range of 50 to 160° C., and the viscosity in the range of 10 to $10^{13}$ cm-P (centi-poise) at temperatures on or greater than the softening point or the melting point. The image fixing system of the present invention successfully solved shortcomings of the conventional art by altering widths of the electric pulse provided to the heating body, or by varying the number of electric pulses supplied to the heating body per prescribed time unit during a process for fixing the image on a single subject to be fixed.

In general, a toner image is fixed by fusing the image, specifically a binder resin which is a fusing component of the toner in the toner image, with heat and pressure onto a subject to be fixed. From the viewpoint of achieving a satisfying fusion, the toner image preferably is exerted a strong pressure, and in order to give strong pressure, the subject to be fixed having a toner image on the substrate preferably is exerted a continuous pressure one after another by a heated thin pressure body disposed in a ridge line in the MD (mechanical direction). The "linear heating body" as referred in the present invention defines a very thin heated pressure body in a rigid line, and does not refer to a heating body such as a nichrome line or the like. The linear heating body may be furnished within the guide roller or may be provided separately from the guide roller. The linear heating body does not necessarily rotate. An example of the linear heating body includes a thermal head or the like. The linear heating body of the present invention may be heated by any known suitable heating methods such as resistance heating, induction heating, high frequency vibration heating, or a laser heating. Further, waveforms of an electric pulse is not limited and may be anything from square, triangle, or sinusoidal. Also, the intervals between the pulses do not necessarily have to be an off-state.

That is, by reducing frequency of electric pulses, or by reducing width of the pulse electricity during the start of fixing to the end of fixing corresponding to a region of an image on a single subject to be fixed, energy for supplying electricity is gradually reduced, and the surface temperature of the heating body is not excessively increased, the temperature of the toner may be maintained generally uniform, thereby generation of hot-offsettings, and irregular glossiness in the image may be inhibited.

In practice, if a ratio of electric supply at the time of starting and ending of the fixing process when converted in the MD (mechanical direction) having length of 420 mm (if the subject to be fixed is applied in a longitudinal direction of A3 as defined in JIS P 0138), is 10:9 to 10:1, fixing was proved to be carried out stably in a manner of the present invention, and when accounting for fluctuation in actual condition of use, preferably is in the range of 10:8 to 10:2, and more preferably is 10:8 to 10:3, and most preferably is 10:7 to 10:4, all of which extremely surpass energy savings accomplished in the conventional art. Here, decrease in electric supply (amount of electricity) may be carried out continuously, or in a step-down approach, as far as gradual decrease is maintained. However, allowing for minor fluctuations under various operating conditions, a step for cooling as furnished in the present invention may be necessary after the step for heating.

Generally, fixing of toners is carried out under a state so-called "rubber region of the resin" which refers to a phenomenon in which, as the temperature of the toner increases, resin in the toner begins to intenerate, and leads to deterioration in viscosity of the resin. Note that "rubber-like region" herein does not refer to an elastic restoring force when a power is exerted to deform a high polymer material and released thereafter, but rather to a factor for decrease in stress (or creep factor) of the material itself. The toner in the conventional roller fixing system has an extremely high viscosity in the resin contained in the toner, exhibits high self cohesion in a so-called rubber-region which covers from inteneration to a complete melting, thus hardly causes offsetting meaning a portion of the toner adheres on the fixing roller. However, when the toner is complete melted, the viscosity of the toner remarkably drops to cause deterioration in self-cohesion, and causes portion of the toner to adhere to the fixing roller.

In general, when a thermoplastic resin is heated, it usually remains solid up to the softening point, and then becomes soft to exhibit viscosity above the softening point, and reaches a state of viscous liquid when further heated above the melting point. The conditions such as range of temperature between the softening point and the melting point, viscosity of the toner from the softening point to the melting point and above the melting point, are subject for change with respect to molecular amount of the resin, distribution of molecular amount, rate of crystallization, rate of cross-linking, and intermolecular forces. Accordingly, resins which exhibit 10 to $10^{13}$ cm-P (centi-poise) in between the softening point and the melting point may be used in the present invention from on or above the softening point, and apparently on or above the melting point. Therefore, the term "rubber-like region" used herein does not refer to an elastic restoring force when a power is exerted to deform a high polymer material and released thereafter, but rather to a factor for decrease in stress (or creep factor) of the material itself.

When the melt viscosity of the toner is low, apparently the deterioration in viscosity in a state of rubber-like region becomes intense, and accordingly, such toners are not qualified for use in the heat roller fixing system of the conventional art due to off-setting caused if used without coating silicone oil on the surface of the roller. However, when viscosity of the oil is extremely low, a method for coating oil tends to be expensive and becomes a burden to the user.

Consequently, in an actual fixing process utilizing the heat-rollers, the fixing is performed within the range of viscosity under the rubber region. However, as disclosed in the Japanese Patent Publication UP-B) No. 51-29825, immediately after heating, without removing the subject to be fixed from the fixing member, removing is carried out after the step for cooling, thereby removing is performed after the toner is cooled and solidified. Accordingly, under this method, compared to other conventional methods, toners do not adhere to the fixing member even when viscosity of the toner at the time of melting is low, and thus leaving much room for allowance.

In FIG. 1, one example of an image fixing apparatus of the present invention furnished with heating and cooling function is shown. In the apparatus shown in FIG. 1, a resistance or a heat generation inducing body (H1), a guide roller (G3) which accommodates the heat generation inducing body within itself and which also acts as a heat fixing roller, an endless belt (B) entrained around the guide rollers (G1), (G2) and (G3), means for supplying pulse electricity to the heat generation inducing body (H1), and a pressure body (P4) which interposes a subject to be fixed (P3) bearing an image (P1) on a substrate (P2) between the pressure body (P4) and the endless belt (B), is provided. The pressure body (P4) in this example is configured by a conveyance belt (Cv) crossed from the pressure roller (G4) and the guide roller (G5).

The guide roller (G1) and the guide roller (G2) may either be a drive roller and the other a driven roller, or either one of the rollers may be a cooling roller. In this example, the guide roller (G2) acts as the cooling roller for the image (P1) on the subject to be fixed (P3) which is conveyed in the direction of advance from left to right on the endless belt (B) as indicated by an arrow in the figure. In the apparatus in FIG. 1, the guide roller (G2) is configured to have a greater diameter than the guide roller (G3) which also acts as the fixing roller, or the guide roller (G1) which also acts as the driving roller, in order to secure enough surface area to be cooled. In the present invention, any means for cooling in addition to the guide roller (G2), or replacing the guide roller (G2) may be provided in the image fixing apparatus. The image (P1) on the subject to be fixed (P3) is heated with the heating body (H1) by way of endless belt (B), thereafter going through a process for cooling by the guide roller (G2) which also acts as means for cooling, and then the subject to be fixed bearing the image (P2) is separated from the endless belt (B).

The controlling system of the image fixing apparatus in this example includes: means for controlling supply of electricity (A1) for a heater which is the heating body (H1) including means for switching supply of electricity, and means for controlling the rotation (A2) of a pulse motor (M) for driving the guide roller (G1) which also acts as drive roller, and these means for controlling (A1) and (A2) receives an image signal from the image position sensor (S) which monitors a location of the image (P1) on the subject to be fixed (P3). These means for controlling (A1) and (A2) are controlled by the controller (B1) connected to the RAM (B2) and ROM (B3), and controls supply of electricity from the electricity source (A3). The guide roller (G3), which also acts as heat fixing roller, is furnished with a thermal sensor such as thermistor (SM), and an output signal from the thermistor is sent to the means for controlling (A1) and used for switching operation to switch supply of electricity in the means for switching electricity (not shown in the drawings). In heating the toner image for fixing, the supply of electricity does not necessarily be a pulse electricity, and when the subject for controlling which is, for instance, a voltage and/or a electric current, is provided in an amount defined in analogue, it is not impossible to control the analogue amount using a digital signal as the subject to be controlled. However, in this example, supply of electricity is used as an amount of pulse electricity which is not only the amount for controlling, but also an amount to be controlled (subject for controlling). Needless to say the merit of such controlling system is well known by the ones skilled in the art.

Figure 2:
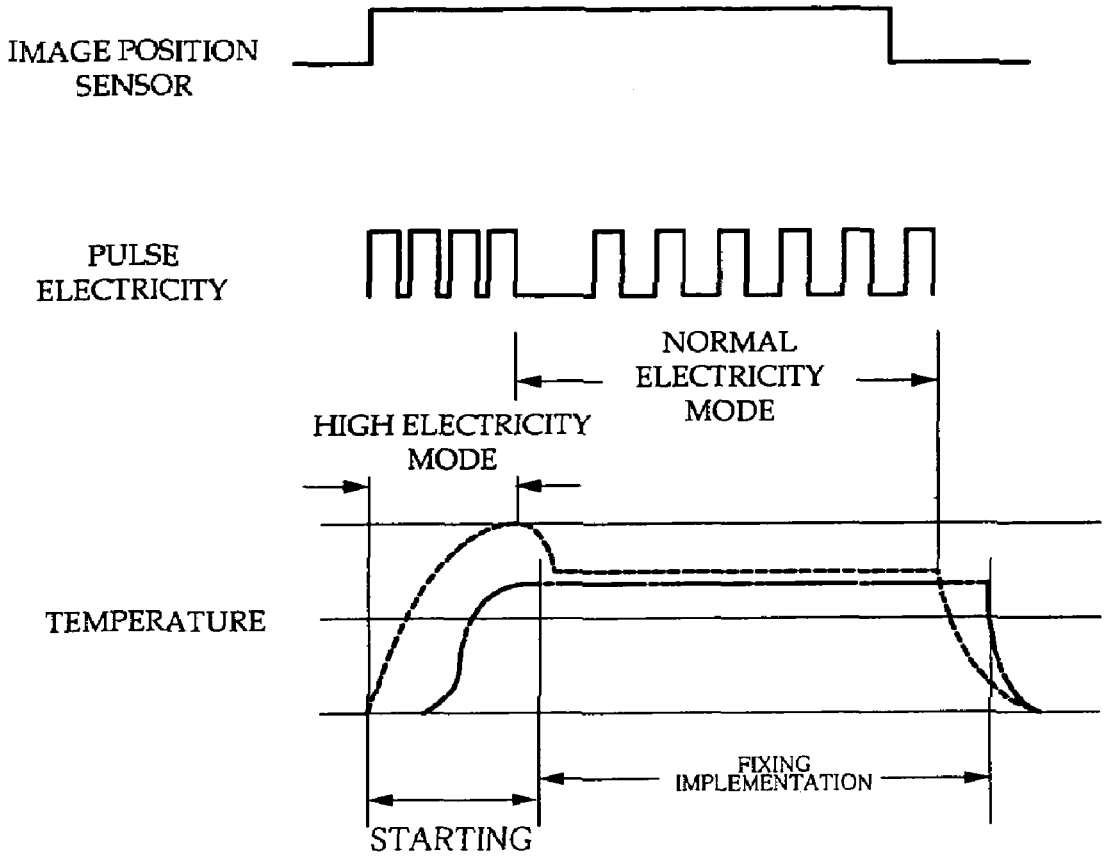
FIG. 2 is a diagramic view showing a relationship of pulse electricity for the means for controlling heat electricity to the heating body, and a temperature variance of the heating body.

FIG. 2 shows one example of a temperature variance for the electric pulse supplied to the heater (H1) in the means for controlling supply of electricity (A1), and the heater (H1). First, in accordance with the timing of electric supply synchronized with the output signal of the image position sensor (S), before the image (P1) on the subject to be fixed (P3) reaches the guide roller (G3) which combines the role of heat fixing roller, when electricity is supplied in a high electricity mode, i.e, the pulse electricity having a dense pulse electricity cycle and/or having extended supply of electricity per pulse is supplied to the heater (H1), the heater is rapidly heated as shown in the solid curved line in the figure. At this time the heater is heated by a multiple pulse electricity. Accordingly, when the image (P1) on the subject to be fixed (P3) reaches the heater (H1), the heater is well heated in the temperature as shown in the dotted-line, to melt fix the toner image. Thereafter, the means for electric supply only requires feeding a constant electric pulse having constant pulse width to the heater until the position sensor (S) no longer monitors the image on the substrate (P2) and the output signal becomes low in which the cutoff timing of the electric supply is synchronized, thereby the means for supplying electricity (A1) stops providing electricity to the heater (H1). However, the temperature of the heater (H1) still remains high enough to fix the remainder of the image after the electric supply is being cutoff.

Figure 3:
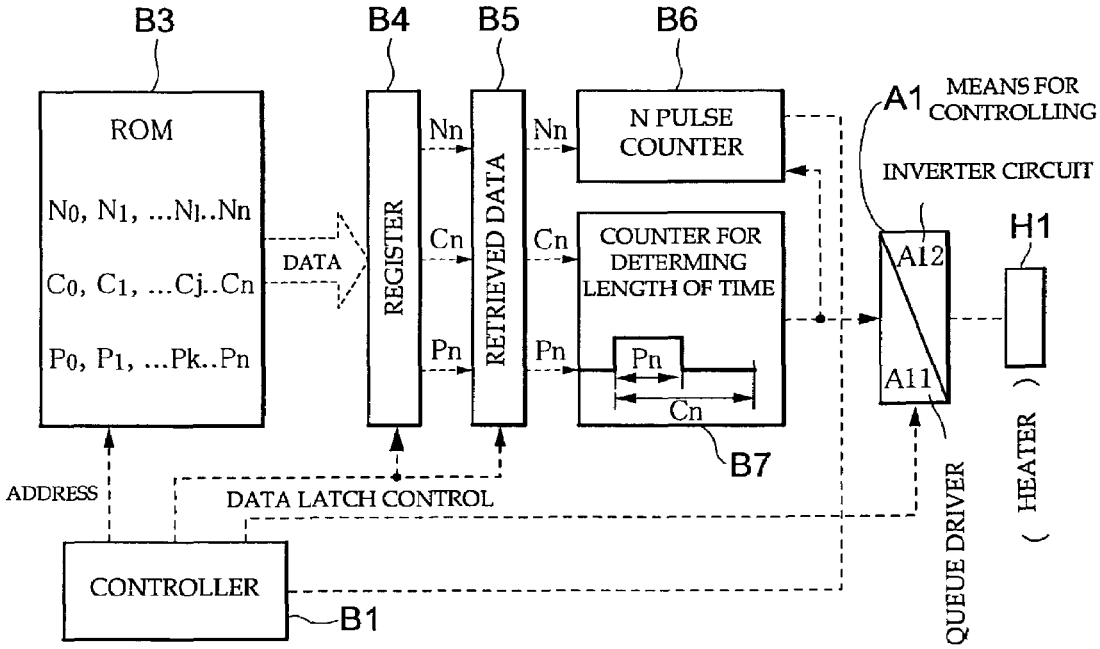
FIG. 3 is a block diagram showing one example of a controlling system for controlling the means for controlling heat electricity.

FIG. 3 is a block diagram showing one example of the control system in which the controller (B1) controls the means for controlling supply of electricity (A1) which provides pulse electricity to the heater (H1). The control system integrates a sensor (S) connected to the controller (B1), ROM (Read Only Memory—B3), RAM (Random Access Memory—B2), and a sequence program readable and updatable for sequentially controlling the means for controlling (A1) and (A2), and a program for interfacing a level signal of the thermal sensor (SM) acting as output of the inverter circuit (A12) and a pulse signal of the queue driver portion (A11) in a readable, updatable manner.

When the number of pulses in a series of electric pulses is defined as Nn, frequency of the pulses as Cn, and a length of time as Pn, the respective data for Nn, Cn, and Pn are initially stored in the ROM (Read Only Memory) (B3) in advance in a manner to allow reading out. Next, triggered by an address signal provided to the ROM (B3) from the controller (B1), the retrieved data (Nn, Cn, and Pn) are sequentially sent to a register (B4) and to a data latch unit (B5), both of which are controlled by the controller (B1). In the controller, the data Nn is sent to N pulse counter (B6), while data (Cn and Pn) are sent to the counter for determining length of time in supplying electricity (B7).

The counter for determining length of time in supplying electricity (B7) determines a length in time for electric supply per one pulse data (Cj, Pk), and feeds the data to the queue driver (A11) of the means for controlling supply of electricity (A1). The queue driver (A11) outputs prescribed pulses in accordance with the sequential order of the data representing time of electric supply, and drives the heater (H1). At the same time, the N Pulse counter (B6) counts the number of output electric pulses, and sends signal to the controller (B1) after counting reaches the data Ni.

In this manner, the controller (B1) outputs address signals for the next cycle, and also controls the register (B4) and the data latch unit (B5). For example, in the present invention, values for the respective data may be determined at Cn=10 ms constant, $P_c$=9 ms and $N_c$=30 at the time of temperature rise, $P_1$=2 ms and $N_1$= in the range of 213 to 215 at the time of controlling temperature isothermally. Here, the length of time for electric supply, number of pulses for each mode is defined based on the data collected in advance.

Therefore, such means for controlling supply of electricity (A1) may be varied in the fixing process for each of the image (P1) on a single subject to be fixed (P3). Further, in the figure, the means for controlling supply of electricity (A1) of the heater (H1) is shown as a mode having extended supply of electricity per pulse (P) in which the number of pulse electricity cycle is dense (C), and a normal (constant) mode which comes thereafter. When the heater (H1) has an excellent heat-blocking property, the temperature of the heater as the heating body may gradually increase, pulse width per unit time or the number of pulses provided to the heater (H1) preferably is reduced during the process for fixing from the start of heating until the end of heating for all of the images in a single subject to be fixed (B3).

Therefore, it is preferable to configure the means for controlling supply of electricity (A1) of the present invention to hold off supply of electricity to the heating body (H1) before the front edge of the image (P1) reaches the position of the heating body which is a heater (H1), and/or the means for supplying electricity (A1) to stop the supply of electricity immediately after the rear-edge of the image (P1) passes through the position of the heating body even if the rear-end of the substrate (2) bearing the image (P1) is still on its way to pass the position of the heating body.

Figure 4:
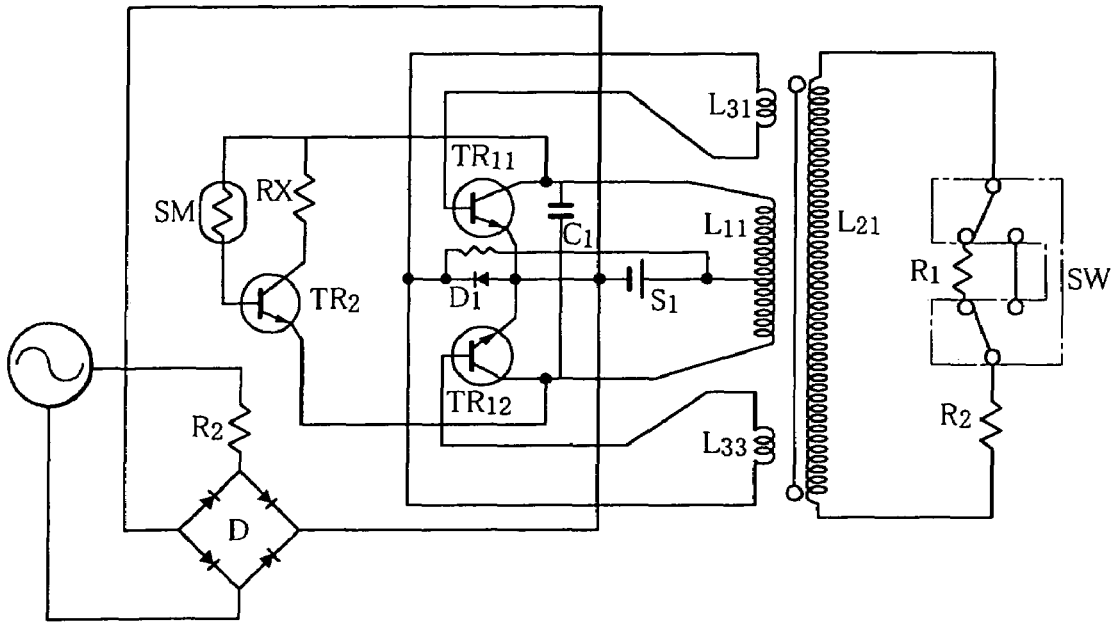
FIG. 4 is a circuit diagram showing one example of a control circuit in the means for controlling heat electricity furnished with means for starting, stopping, and switching the electricity provided to the heating body.

FIG. 4 shows one example of a control circuit as a method for starting, ending, and switching supply of electricity to the heater (H1) controlled by the method for finely adjusting supply of electricity of the device of the present invention. In this example, a self-running multivibrator for the heating body (H1) is formed by a transistor (TR11) and a transistor (TR12). By electrically conducting the transistor (TR11) and the transistor (TR12) alternatively, secondary induction high voltage corresponding to alternating inputs to a primary coil (L11) of a transformer are output to the secondary coil (L21). Then, by utilizing these as electric power source to the heating body (H1) having registers (R1) and (R11) as a load resist (R1), it is performed to start, end, and switch supply of electricity at the time of heating by the pulse electricity. Further, the self-active multivibrator is controlled by a feed back circuit comprising a transistor (TR1), resist (Rx), and a thermistor (SM) as the thermal sensor in FIG. 1, in which a negative in-out relationship is established to a load fluctuation of the self-active multivibrator circuit.

The self-active multivibrator is devised to conduct the primary coil (L11) of the transformer when one transistor (TR11) turns to be conductive. Consequently, while the secondary inductive output voltage is outputted to the secondary coil (L21) after a short while and then used as a heater source, the third inductive output voltage generated after a short while is output to the primary coil (L11) due to this secondary output voltage. Then, this third inductive output voltage generated after a short while is fed back to the other transistor (TR12) to render it conductive, and the transistor (TR12) functions in the same way as the transistor (TR11). Then, this operation is repeated alternatively to operate the multi-vibrator. A condenser (C1) is used to set a time constant (that is, a frequency of the pulse electricity) at the time of electrically conducting both transistors by cooperating with the primary coil (L11) of the circuit. Further, a direct current component from a rectifier (D) is given as the power supply to this circuit.

Therefore, this self-active multivibrator is used to determine the lowest and the highest limits in the temperatures during heating by the heater (H1) of the fixing device of the present invention. Hence, it determines the range of temperatures as illustrated in FIG. 2 by the means for controlling (A1). A push-pull type switch (SW) is configured to allow the heater (H1) to switch between a high calorific value (R1+R2) and a low calorific value (R2 only).

Further, it is possible to combine a conventional method for protecting circuit elements from surge voltage. For example, a Zener diode which turns electrically conductive at the time of reaching zener break voltage is connected parallel to the resist (R3) plus rectifier (D) to protect the rectifier (D) from a sudden over voltage current, thus it is possible to provide an over current bypass path at the portion of a resist (R3) for the rectifier (D). In the case of such circuit, not only having a merit of pulse electricity output, but also leaves out a back electromotive force absorption circuit having a general high time constant, which includes the diode and the resistance.

Figure 5:
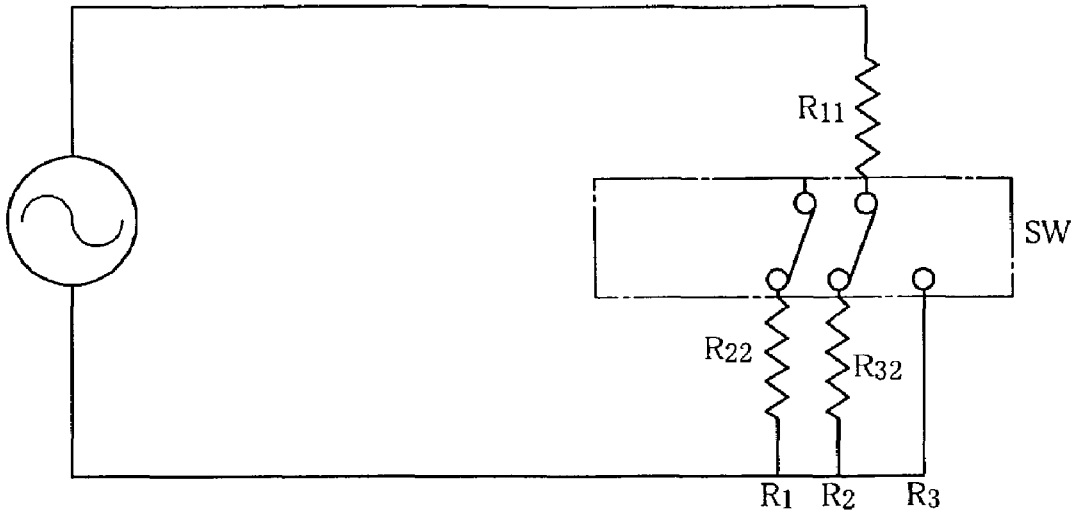
FIG. 5 is a schematic circuit diagram showing one example of a three-step temperature control unit for determining temperatures—high, intermediate, and low, of the heating body.

As shown in FIG. 5, it is possible to switch temperatures in three stages such as high temperature (R11+R22), medium temperature (R11+R32), and low temperature (R11 only). Further, it is also possible to switch temperatures in five stages.

Figure 6:
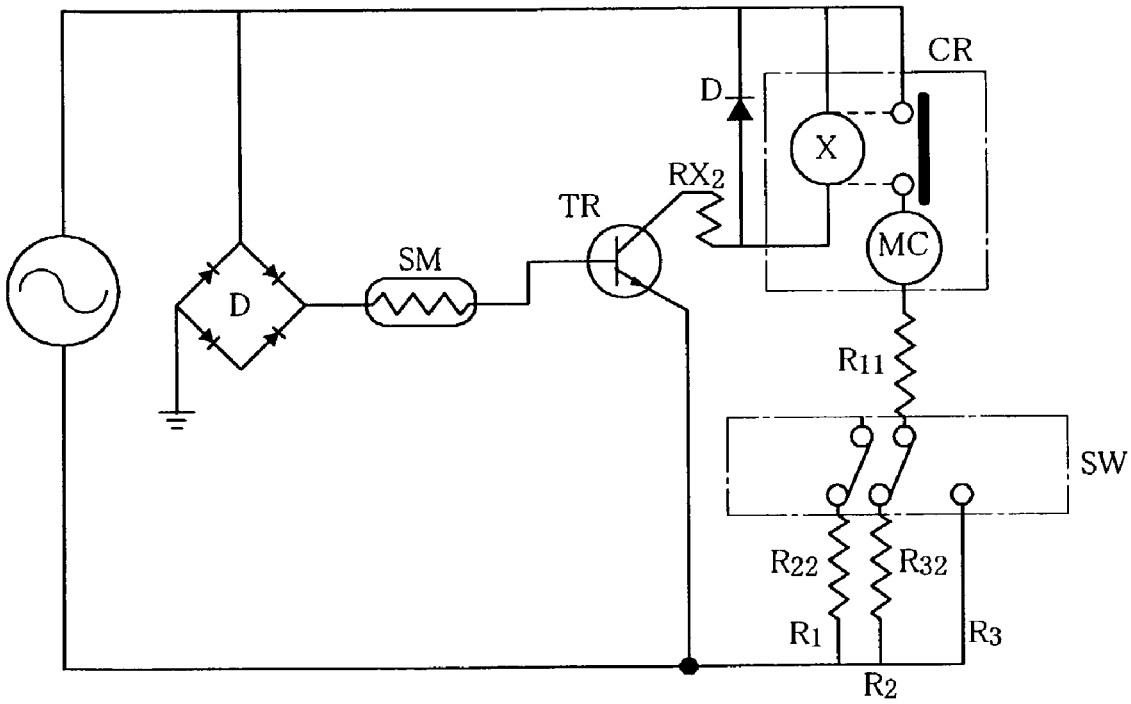
FIG. 6 is a circuit diagram showing one example of a control circuit furnished with starting, stopping, and switching supply of electricity to the heating body.

In FIG. 6, there is shown another example of the control circuit as starting, ending, and switching methods for supplying electricity to the heating body (H1) in relation to the fixing device of the present invention. Another example of the control circuit for starting, stopping, and switching electricity supply to the heater (H1) of the fixing device of the present invention is shown in FIG. 6. In this case also, the load resist (R1) of the heating body (H1) is expressed only by the resist (R1) of the heating body (H1) in a case of low temperature heating, and by the resist (R11+R12) for heating in high temperature, while means for switching temperature (7) is shown as an electric switch (SW). In the example in the figure, means for switching and opening-closing the line electricity supply to the heater (H1) is configured by an electric supply circuit control (CR) and the transistor (TR), the electric supply circuit control (CR) comprises an electromagnetic switch (X) for opening and closing the electromagnetic switch. The transistor (TR) amplifies output by a temperature sensor such as the thermistor (SM) for driving the electromagnetic switch (X). When the output signal is fed to the base electrode of the transistor (TR) through the thermistor (SM), this transistor (TR) turns electrically conductive, and magnetizes the electromagnetic switch (X). The circuit formed of the rectifier (D) and the resist (Rx2) in the example absorbs back electromotive force generated at the time of turning off the electromagnetic switch (X) in order to protect the circuit. Further, the rectifier (D) is a power source for a method of controlling volume of electricity supply, comprised of the electric supply circuit control (CR) and the transistor (TR).

Figure 7:
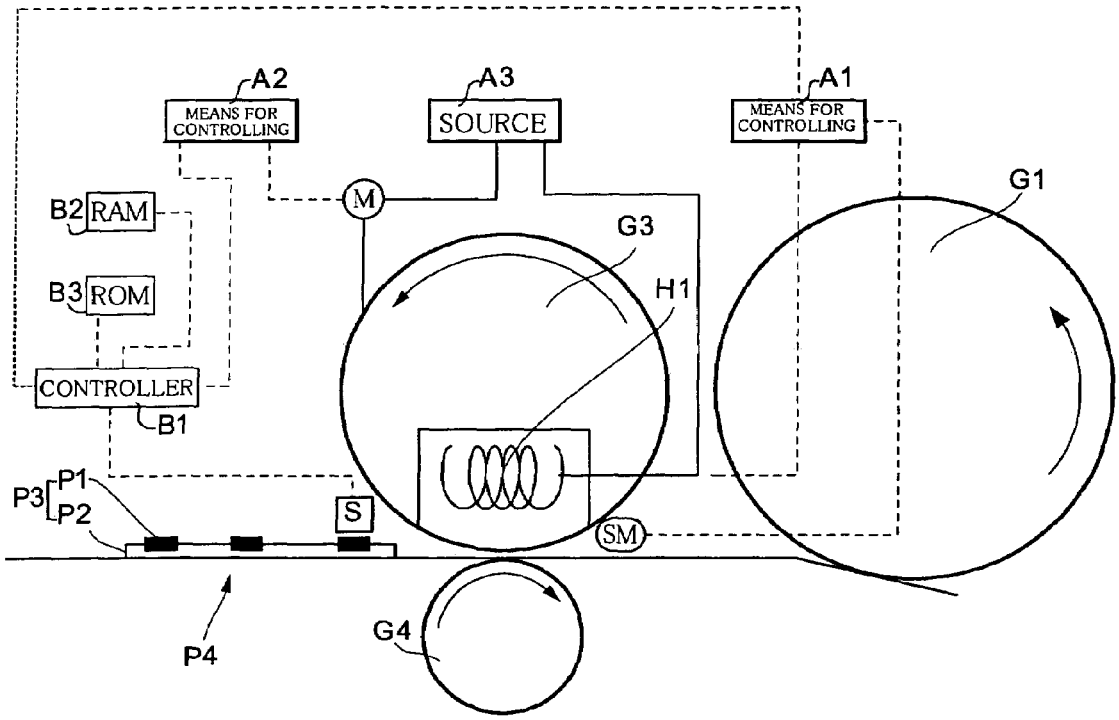
FIG. 7 is a schematic view showing another example of an image fixing apparatus of the present invention.

In FIG. 7, another example of the fixing device of the present invention is shown. In the example, the endless belt (B) is entrained about and links the guide rollers (G1), (G2) and the fixing roller (G3), however, it may also be arranged to nip the conveying belt (Cv) by the pressure roller (G4) and the guide roller (G3) positioned in the heater (H1), thereby conveying the subject for fixing by the force of friction. In the fixing device shown in FIG. 7, the guide roller (G1) also acting as the means for controlling is configured to have larger diameter than the pressure roller (G4) to ensure enough surface area for cooling.

EXAMPLE

Figure 8A:
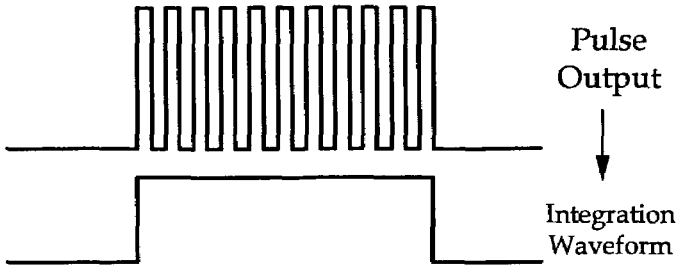
FIG. 8A through FIG. 8C are graphic views showing examples of pulse outputs applied to a heater (H1) of the present invention and an integration waveform.
Figure 8B:
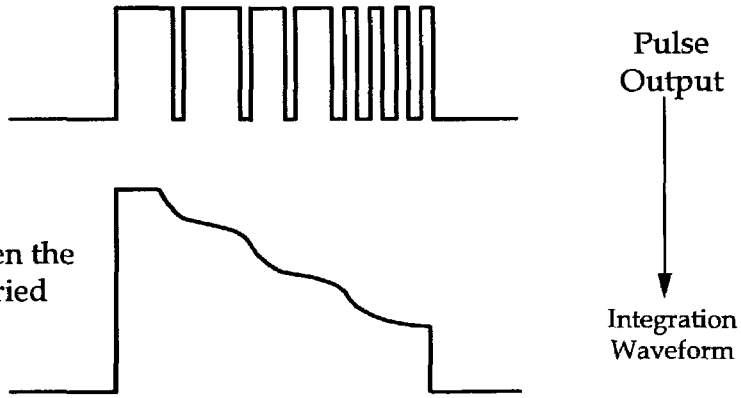
Figure 8C:
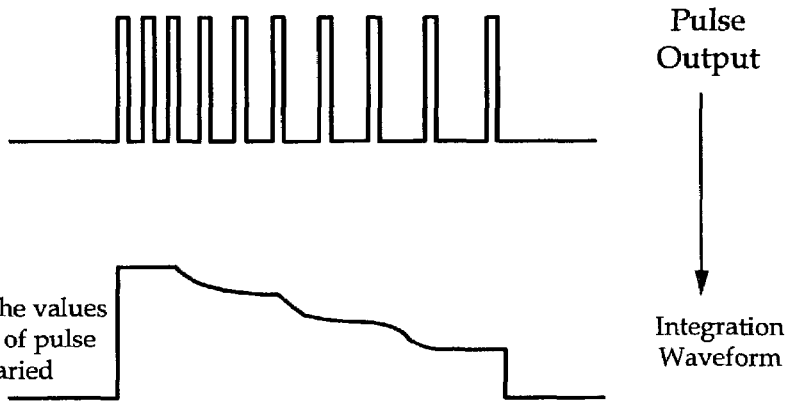

The present invention will be described in detail using examples. In the present invention, amount of electric supply as the subject to be controlled acquires a shape of pulse waveform. When such pulse electricity is applied to the heater (H1), in the heat fixing roller as a heating body which directly performs fixing, the amount of heat is diffused multi-dimensionally, and as shown in chart representing output amount of the heat from the roller (G3) in FIG. 8A to FIG. 8C, shaped in a single integral waveform in which the pulse output is integrated.

Example 1

Figure 9A:
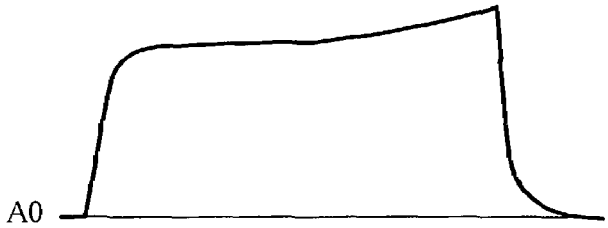
FIG. 9A through FIG. 9D are graphic views showing examples of integration waveforms of a guide roller of the present invention and a heat distribution status.
Figure 9B:
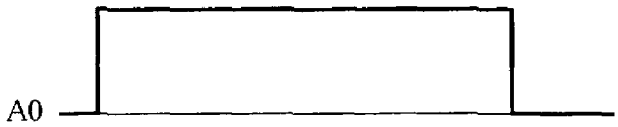
Figure 9C:
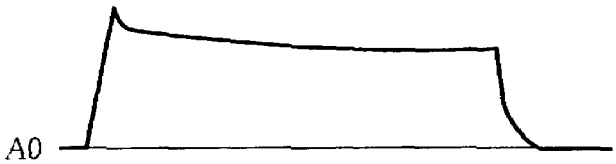
Figure 9D:
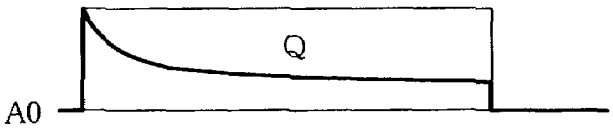
Figure 10:
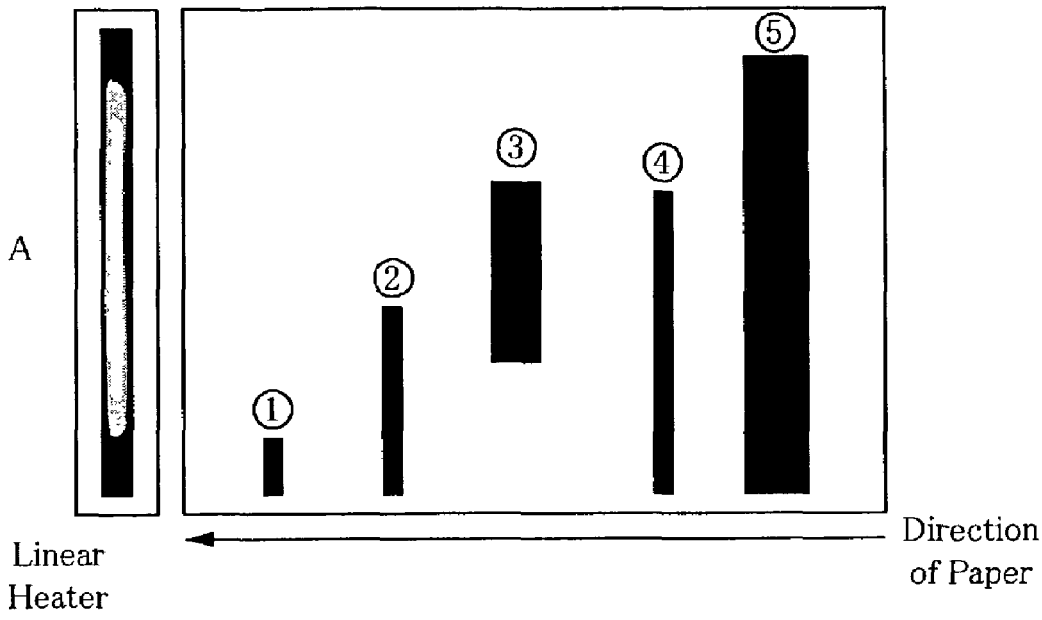
FIG. 10 is a schematic view showing an effect of images 1, 2, 3 and 4 respectively to the heat distribution of the integration waveform of the guide roller (G1), when the heater is configured in a shape of pole, thereby showing a status of energy saved when images on papers are subjected in the image fixing apparatus of the present invention.
Figure 11:
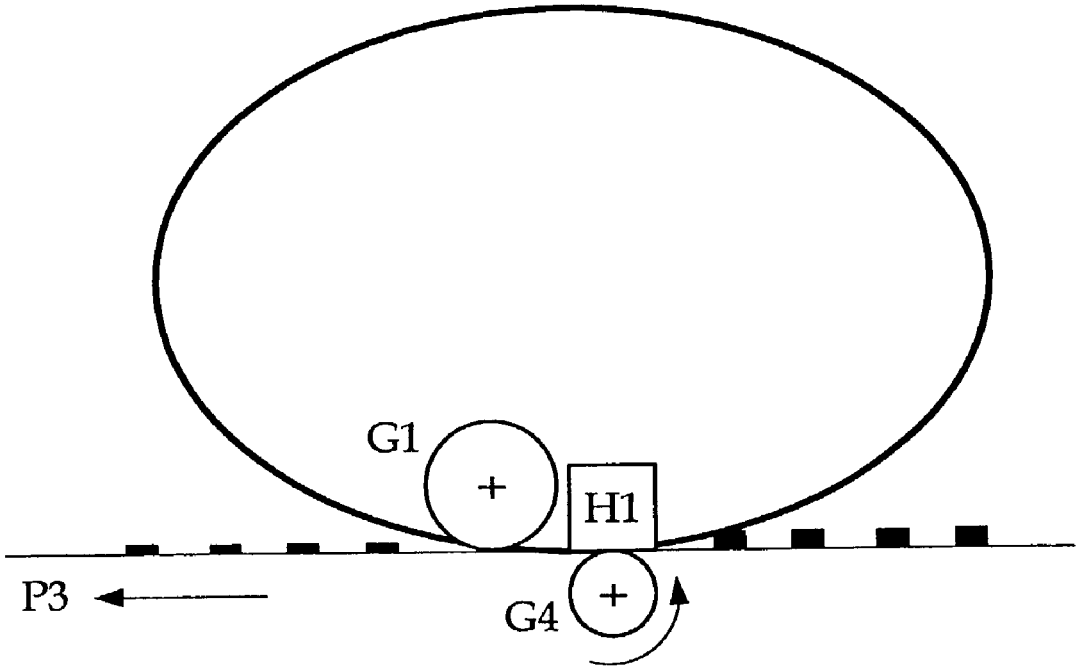
FIG. 11 is a schematic view showing another example of a pressure roller (G4) and a guide roller (G1) interposing an image on a subject to be fixed in the image fixing apparatus of the present invention.

FIG. 9A through FIG. 9D shows relationships of heat distributions of the integral waveforms of the electric pulse against the guide roller (G3). The items expressed as FIG. 9B and FIG. 9D are values of integrated pulses when the paper is conveyed past over the linear heating body, while FIG. 9A and FIG. 9C show the status of temperature variance of the fixing roller. The values of pulse-width, and pulse density (density of pulse electricity cycle) of FIG. 9A and FIG. 9B are left constant, and the temperature of the fixing roller with time is increased. On the contrary, the values of pulse integration with time are decreased for items FIG. 9C and FIG. 9D when the pulse-widths or pulse density (density of pulse electricity cycle) are varied, and initially an overshoot in temperature may be observed while maintains constant temperature due to an effect of heat accumulation. Since an energy consumption corresponds to values of pulse integration, an area represented by reference numeral "Q" in FIG. 9A through FIG. 9D represents a saved energy, thus an effect of energy savings attained by the present invention may be clearly confirmed. FIG. 10 illustrates an influence of the guide roller (G1) to the heat distribution of the integrated waveforms shown in FIG. 9A through FIG. 9D, presented for each images, when the heating body (heater) of the present invention is configured in a shape of a rod. The saving of energy attained by the present invention is shown by actually feeding papers in the device. In the FIG. 10, numerals 1 through 5 represent images on a sheet of paper, and each one of the images are heated with the integral waveforms controlled by the method of the present invention. Further, by using a toner having relatively low melt viscosity of 10 (superscript: 4) to print out three lines of solid images disposed 2 centimeters apart having 2 centimeters in width in the direction of advance, problems such as image expansion or off-setting was not caused due to an effect of controlled integral waveforms of the present invention, and for all three lines, a uniform solid images in quality were obtained.

As clearly understood from a concrete as well as thorough descriptions in the foregoing, the present invention brings an explicit effect of stability in actual operation without causing off-settings and the like, and attains further energy savings using a process for fixing toner images and an image fixing apparatus of the present invention.

What is claimed is:

1. An image fixing apparatus, comprising:

a linear heating body;

an endless belt entrained around thereon;

means for supplying electricity to the linear heating body with pulse electricity;

a pressure body for interposing a subject to be fixed having an image between the endless belt and the pressure body;

the image on the subject to be fixed is heated by the linear heating body through the endless belt, and thereafter being cooled and removed from the endless belt;

wherein the image is formed by a toner comprising a binder containing a resin as a main component, and wherein the means for supplying electricity comprises means for controlling supply of electricity which variably controls one of a pulse width and a pulse density per unit time of an electricity supplied to the linear heating body during a process for fixing the image on the subject, and wherein a ratio of the supply electricity to the heating body at a time of starting of the process for fixing the subject to the supply electricity to the heating body at a time of ending of the process for fixing the subject is 10/9 to 10/1.

2. An image fixing apparatus according to claim 1, wherein the means for supplying electricity comprises means for controlling supply of electricity which variably controls a pulse width of an electricity supplied to the linear heating body during a process for fixing the image on the subject.

3. An image fixing apparatus according to claim 1, wherein the means for supplying electricity comprises means for controlling supply of electricity which variably controls a density in electric pulse cycles per unit time supplied to the linear heating body during a process for fixing the image on the subject.

4. An image fixing apparatus according to claim 1, wherein the means for supplying electricity comprises means for controlling supply of electricity which variably controls a combination of a pulse width in the electric pulse and a density of electric pulse cycles per unit time supplied to the linear heating body during a process for fixing the image on the subject.

5. An image fixing apparatus according to claim 1, wherein the means for controlling supply of electricity reduces one of a pulse width and a number of pulses per unit time of the pulse electricity supplied to the linear heating body during a process for fixing the image on the subject.

6. An image fixing apparatus according to claim 1, wherein the means for controlling supply of electricity applies one or more pulses to the linear heating body before a front-end portion of the image on the subject to be fixed reaches a position of the linear heating body.

7. An image fixing apparatus according to claim 1, wherein the means for controlling supply of electricity holds off supply of electricity to the linear heating body before a front-end portion of the image on the subject to be fixed reaches a position of the linear heating body, in accordance with heat accumulation of the linear heating body, for a second and successive images when the subject to be fixed has a plurality of images.

8. An image fixing apparatus according to claim 1, wherein the means for controlling supply of electricity stops supplying electricity after a rear-end portion of the image passes through a position of the linear heating body, and before a rear-end portion of the subject to be fixed reaches a position of the linear heating body.

9. An image fixing apparatus according to claim 1, wherein the linear heating body is provided inside a guide roller furnished with a thermal sensor.

10. An image fixing apparatus according to claim 1, wherein one of a softening point and a melting point of the toner is in the range of 50 to 160° C., and a viscosity of the toner is in the range of 10 to $10^{13}$ centi-poise at a temperature greater than either the softening point or the melting point of the toner.

11. An image fixing apparatus according to claim 1, wherein one of the pulse width and the pulse density are controlled in function of the image on the subject and in function of a temperature of the linear heating body.

12. A process for fixing an image, comprising:

heating an image on a subject to be fixed by a linear heating body through an endless belt; and separating the subject to be fixed from the endless belt after the image is cooled;

wherein the subject to be fixed is interposed between a pressure body and the endless belt entrained around the linear heating body which receives pulse electricity from means for supplying pulse electricity, and an amount of the pulse electricity is adjusted based on data of the image to be fixed, wherein said data is collected before the fixing, and the image is formed by a toner comprising a binder containing a resin as a main component, and wherein a ratio of the supply electricity to the heating body at a time of starting of the process for fixing the subject to the supply electricity to the heating body at a time of ending of the process for fixing the subject is 10/9to 10/1.

13. A process for fixing an image according to claim 12, wherein the means for supplying electricity comprises means for controlling supply of electricity which variably controls one of a pulse width and a pulse density per unit time of an electricity supplied to the linear heating body during a process for fixing the image on the subject.

14. A process for fixing an image according to claim 13, wherein a combination of a pulse width in the electric pulse and a density of electric pulse cycles per unit time supplied to the linear heating body is variably controlled during a process for fixing the image on the subject.

15. A process for fixing an image according to claim 13, wherein one of a pulse width and a number of pulses per unit time of the pulse electricity supplied to the linear heating body is reduced during a process for fixing the image on the subject.

16. A process for fixing an image according to claim 13, wherein one or more pulse to the linear heating body is applied before a front-end portion of the image on the subject to be fixed reaches a position of the linear heating body.

17. A process for fixing an image according to claim 13, wherein the supply of electricity to the linear heating body is cut-off before a front-end portion of the image on the subject to be fixed reaches a position of the linear heating body, in accordance with heat accumulation of the linear heating body, for a second and successive images when the subject to be fixed has a plurality of images.

18. A process for fixing an image according to claim 13, wherein the supply of electricity to the linear heating body is stopped after a rear-end portion of the image passes through a position of the linear heating body, and before a rear-end portion of the subject to be fixed reaches a position of the linear heating body.

19. A process for fixing an image according to claim 12, wherein the linear heating body is provided inside a guide roller and the supply of electricity is controlled by a temperature of the guide roller.

20. A process for fixing an image according to claim 12, wherein one of a softening point and a melting point of the toner is in the range of 50 to 160° C., and a viscosity of the toner is in the range of 10 to $10^{13}$ centi-poise at a temperature greater than either the softening point or the melting point of the toner.

21. An image fixing apparatus, comprising:

a linear heating body;

an endless belt entrained around thereon;

means for supplying electricity to the linear heating body with pulse electricity;

a pressure body for interposing a subject to be fixed having an image between the endless belt and the pressure body;

the image on the subject to be fixed is heated by the linear heating body through the endless belt, and thereafter being cooled and removed from the endless belt;

wherein the means for supplying electricity comprises means for controlling supply of electricity which variably controls one of a pulse width and a pulse density per time unit of an electricity supplied to the linear heating body during a process for fixing the image on the subject, wherein the image is formed by a toner comprising a binder containing a resin as a main component, and one of a softening point and a melting point of the toner is in the range of 50 to 160° C., and a viscosity of the toner is in the range of 10 to $10^{13}$ centi-poise at a temperature greater than either the softening point or the melting point of the toner, and wherein the means for controlling supply of electricity reduces one of a pulse width and a number of pulses per unit time of the pulse electricity supplied to the linear heating body during a process for fixing the image on the subject.

22. An image fixing apparatus according to claim 21, wherein a time ratio between a period of a time of starting of the process for fixing a single subject until a time of ending of the process for fixing a single subject and a period of a time of supply of electricity of the heating body is 10:9 to 10:1, when the subject to be fixed is moved in a length of 420 mm in a mechanical direction.

23. An image fixing apparatus according to claim 21, wherein the means for controlling supply of electricity holds off supply of electricity to the linear heating body before a front-end portion of the image on the subject to be fixed reaches a position of the linear heating body, in accordance with heat accumulation of the linear heating body, for a second and successive images when the subject to be fixed has a plurality of images.

24. An image fixing apparatus according to claim 21, wherein the means for controlling supply of electricity stops supplying electricity after a rear-end portion of the image passes through a position of the linear heating body, and before a rear-end portion of the subject to be fixed reaches a position of the linear heating body.

25. A process for fixing an image, comprising:

heating an image on a subject to be fixed by a linear heating body through an endless belt; and separating the subject to be fixed from the endless belt after the image is cooled;

wherein the subject to be fixed is interposed between a pressure body and the endless belt entrained around the linear heating body which receives pulse electricity from means for supplying pulse electricity, and the image is formed by a toner comprising a binder containing a resin as a main component, and one of a softening point and a melting point of the toner is in the range of 50 to 160° C., and a viscosity of the toner is in the range of 10 to $10^{13}$ centi-poise at temperature greater than one of the softening point and melting point of the toner; and the means for supplying electricity comprises means for controlling supply of electricity which variably controls one of a pulse width and a pulse density per time unit of an electricity supplied to the linear heating body during a process for fixing the image on the subject, and wherein one of a pulse width and a number of pulses per unit time of the pulse electricity supplied to the linear heating body is reduced during a process for fixing the image on the subject.

26. A process for fixing an image according to claim 25, wherein a time ratio between a period of a time of starting of the process for fixing a single subject until a time of ending of the process for fixing a single subject and a period of a time of supply of electricity of the heating body is 10:9 to 10:1, when the subject to be fixed is moved in a length of 420 mm in a mechanical direction.

27. A process for fixing an image according to claim 25, wherein the supply of electricity to the linear heating body is cut-off before a front-end portion of the image on the subject to be fixed reaches a position of the linear heating body, in accordance with heat accumulation of the linear heating body, for a second and successive images when the subject to be fixed has a plurality of images.

28. A process for fixing an image according to claim 25, wherein the supply of electricity to the linear heating body is stopped after a rear-end portion of the image passes through a position of the linear heating body, and before a rear-end portion of the subject to be fixed reaches a position of the linear heating body.

29. An image fixing apparatus, comprising:

a linear heating body;

an endless belt entrained around thereon;

means for supplying electricity to the linear heating body with pulse electricity;

a pressure body for interposing a subject to be fixed having an image between the endless belt and the pressure body;

the image on the subject to be fixed is heated by the linear heating body through the endless belt, and thereafter being cooled and removed from the endless belt;

wherein the image is formed by a toner comprising a binder containing a resin as a main component in order to decrease a one of a melting point and a softening point of the toner, wherein an amount of the pulse electricity is adjusted based on data of the image to be fixed, said data is collected before the fixing.

30. An image fixing apparatus according to claim 29, wherein said data collected before the fixing is gathered from at least one position sensor detecting a position of the image to be fixed on said subject.

31. An image fixing apparatus according to claim 30, wherein the means for supplying electricity comprises means for controlling supply of electricity which variably controls one of a pulse width and a pulse density per time unit of an electricity supplied to the linear heating body during a process for fixing each image on the subject.

32. An image fixing apparatus according to claim 30, wherein the means for controlling supply of electricity applies one or more pulses to the linear heating body before a front-end portion of the image on the subject to be fixed reaches a position of the linear heating body.

33. An image fixing apparatus according to claim 31, wherein one or more images can be fixed on said subject.

34. An image fixing apparatus according to claim 32, wherein one or more images can be fixed on said subject.

35. An image fixing apparatus according to claim 29, wherein the linear heating body is provided inside a guide roller furnished with a thermal sensor.

* * * * *